US010563634B2

(12) United States Patent
Tophoven et al.

(10) Patent No.: US 10,563,634 B2
(45) Date of Patent: Feb. 18, 2020

(54) METHOD FOR STARTING AN INTERNAL COMBUSTION ENGINE, DEVICE AND COMPUTER PROGRAM PRODUCT

(71) Applicant: Robert Bosch GmbH, Stuttgart (DE)

(72) Inventors: Jens Tophoven, Tauberbischofsheim (DE); Stephan Uhl, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 555 days.

(21) Appl. No.: 14/899,298

(22) PCT Filed: Jun. 13, 2014

(86) PCT No.: PCT/EP2014/062332
§ 371 (c)(1),
(2) Date: Dec. 17, 2015

(87) PCT Pub. No.: WO2014/206765
PCT Pub. Date: Dec. 31, 2014

(65) Prior Publication Data

US 2016/0146175 A1 May 26, 2016

(30) Foreign Application Priority Data

Jun. 26, 2013 (DE) ..... 10 2013 212 168

(51) Int. Cl.
*F02N 19/00* (2010.01)
*F02N 99/00* (2010.01)

(52) U.S. Cl.
CPC ..... *F02N 19/004* (2013.01); *F02N 99/006* (2013.01); *F02N 2200/02* (2013.01);
(Continued)

(58) Field of Classification Search
CPC ..... F02N 19/004; F02N 2200/02; F02N 2200/022; F02N 2200/023;
(Continued)

(56) References Cited

U.S. PATENT DOCUMENTS 4,340,017 A * 7/1982 Kato ..... F01L 13/08 123/182.1
4,703,723 A * 11/1987 Tamba ..... F02N 19/004 123/182.1
(Continued)

FOREIGN PATENT DOCUMENTS

DE 10260748 7/2004
DE 10309443 9/2004
(Continued)

OTHER PUBLICATIONS

180108 SAEJ300 (1999) Motor Oil Grades—Low Temperature Specifications understanding_motor_oil_viscosity.pdf.*
(Continued)

*Primary Examiner* — Carl C Staubach
(74) *Attorney, Agent, or Firm* — Michael Best & Friedrich LLP

(57) ABSTRACT

The invention relates to a method for starting an internal combustion engine for a motor vehicle, said internal combustion engine having at least two cylinders, a valve drive with at least one inlet valve and at least one outlet valve for each of the cylinders, wherein at least the closing times of the inlet valves can be variably adjusted, and a direct injection system, in particular a gasoline direct injection system, the starting process being initiated by a direct injection and ignition in one of the cylinders. During a starting process, the closing time of at least one inlet valve differs from at least one of the other cylinders dependent on at least one current state value.

7 Claims, 2 Drawing Sheets

(52) U.S. Cl.
CPC .. *F02N 2200/022* (2013.01); *F02N 2200/023* (2013.01); *F02N 2200/024* (2013.01); *F02N 2200/122* (2013.01)

(58) Field of Classification Search
CPC ..... F02N 2200/024; F02N 2200/122; F02N 99/006; F02N 2200/025
See application file for complete search history.

(56) References Cited

U.S. PATENT DOCUMENTS

| | | | | |
|---|---|---|---|---|
| 5,924,395 | A * | 7/1999 | Moriya | B60K 6/46 123/179.18 |
| 8,763,582 | B2 * | 7/2014 | Lewis | F01L 9/04 123/179.16 |
| 9,212,573 | B2 * | 12/2015 | Von Schimonsky | F01L 9/025 |
| 2003/0213454 | A1 | 11/2003 | Grieser et al. | |
| 2005/0087169 | A1 * | 4/2005 | Yoshida | F02D 41/065 123/299 |
| 2006/0168944 | A1 * | 8/2006 | Inoue | B60K 6/445 60/284 |
| 2006/0201469 | A1 * | 9/2006 | Casal Kulzer | F02D 13/0215 123/179.18 |
| 2006/0254550 | A1 * | 11/2006 | Lewis | F01L 9/04 123/179.3 |
| 2006/0272608 | A1 * | 12/2006 | Hara | F01L 13/0015 123/182.1 |
| 2006/0278202 | A1 | 12/2006 | Sieber et al. | |
| 2007/0163531 | A1 * | 7/2007 | Lewis | F01L 9/02 123/179.4 |
| 2007/0209619 | A1 | 9/2007 | Leone | |
| 2009/0020092 | A1 * | 1/2009 | Kishibata | F02D 41/062 123/179.3 |
| 2009/0132155 | A1 * | 5/2009 | Kojima | F02D 11/10 701/113 |
| 2010/0000478 | A1 * | 1/2010 | Yoshikawa | F02N 19/004 123/90.15 |
| 2012/0037105 | A1 * | 2/2012 | Nakamura | F01L 1/053 123/90.16 |
| 2016/0146175 | A1 | 5/2016 | Tophoven et al. | |

FOREIGN PATENT DOCUMENTS

| | | | |
|---|---|---|---|
| DE | 10322361 | | 11/2004 |
| DE | 102006042086 | | 9/2007 |
| EP | 1403512 | | 3/2004 |
| EP | 1526277 | | 4/2005 |
| JP | 2002039038 | A | 2/2002 |
| JP | 2004353501 | A | 12/2004 |
| JP | 2013053610 | A | 3/2013 |

OTHER PUBLICATIONS

190606 NASA Second Law of Thermodynamics (Year: 2008).*
2008 Wayback Machine NASA (Year: 2008).*
International Search Report for Application No. PCT/EP2014/062332 dated Oct. 7, 2014 (English Translation, 3 pages).

* cited by examiner

METHOD FOR STARTING AN INTERNAL COMBUSTION ENGINE, DEVICE AND COMPUTER PROGRAM PRODUCT

BACKGROUND OF THE INVENTION

The invention relates to a method for starting an internal combustion engine for a motor vehicle, said internal combustion engine having at least two cylinders, a valve drive with at least one inlet valve and at least one outlet valve for each of the cylinders, wherein at least the closing times of the inlet valves can be variably adjusted, and a direct injection system, in particular a gasoline direct injection system, the starting process being initiated by a direct injection and ignition in one of the cylinders.

In conventional internal combustion engines, the starting process generally takes place via a so-called pinion starter which accelerates the internal combustion engine by means of a torque applied from the outside up until said internal combustion engine subsequently takes over the further operation by initiating a combustion in the cylinders. The interest in reducing the external torque necessary for starting said internal combustion engine is, for example, also of great interest from usage perspectives. In addition, the pinion starter or, respectively, starter motor can be dimensioned smaller and more cost effectively. The electric machine could be designed smaller in hybrid drive devices because the torque rate for the resistance of the combustion engine drops accordingly.

Such a reduction in torque can be achieved by the use of a so-called decompression start, in which the starting process is initiated by means of injection and ignition in one of the cylinders. In so doing, the first ignition or injection is carried out in the cylinder which is currently situated statically in the expansion phase so that the combustion introduces a torque into the crankshaft of the internal combustion engine. In order to overcome top dead center of the cylinder succeeding in the firing order (succeeding cylinder), it is necessary to discharge a portion of the cylinder charge because the kinetic energy that has built up frequently is not sufficient to compress the complete air mass in the succeeding cylinder. For that reason, a very late closing of the inlet valve is expediently implemented so that the air mass can also be expelled out of the cylinder through the inlet valves. In a six cylinder engine, it can, for example, be necessary to decompress two succeeding cylinders in this manner because a decompression is no longer necessary from the fourth fired cylinder onwards and the full air mass can then be compressed in the succeeding cylinders.

SUMMARY OF THE INVENTION

The method according to the invention has the advantage that a reliable direct start is insured independently of the ambient conditions and service life influences of the internal combustion engine. To this end, provision is made according to the invention for the closing time of at least one inlet valve to differ from at least one of the other cylinders (Succeeding cylinders) dependent on at least one current state value. By the term "the at least one other cylinder", a cylinder which follows the one cylinder, in which initially the injection and ignition occurs, in the firing order is hereby to be understood. In particular, this relates initially to the cylinder which is second in the firing order. By changing the closing time of the at least one inlet valve of the other cylinder dependent on a current state value, the decompression can be adapted to the ambient conditions and/or service life influences so that, for example, the starting process is shortened if the ambient conditions allow this to happen or the starting process is lengthened in order to ensure a reliable run up of the internal combustion engine.

According to one advantageous modification to the invention, provision is made for an ambient temperature and/or an ambient pressure to be acquired as the current state value. Ambient pressure or ambient temperature determine the charge of the respective cylinder for the initial combustion. In addition, the compression work of the succeeding cylinders is thereby influenced. By adapting the closing time as a function of these ambient values, a base closing time can be correspondingly influenced or corrected; thus enabling said base closing time to adequately meet the conditions and the decompression performance requirements.

According to one advantageous modification to the invention, provision is made for an internal combustion engine or motor temperature to be acquired as the current state value. The engine temperature has a decisive influence on the friction in the internal combustion engine and therefore also on the rotational speed curve during the starting process; thus enabling the starting process to be further optimized by adapting the closing time as a function of the engine temperature.

Provision is alternatively or additionally made in a preferable manner for a lubricant condition, in particular a lubricant temperature in the internal combustion engine, to be acquired. In a particularly preferable manner, a viscosity of the lubricant, in particular a value representing the viscosity of the lubricant, is acquired. This acquisition can take place by means of known sensors. The lubricant ages with time, wherein the viscosity thereof changes due to fuel ingress into the lubricant, abrasion and/or carbonization, which has a direct influence on the friction in the internal combustion engine. The temperature of the lubricant in the internal combustion engine likewise has an effect on the engine friction and thus on the decompression moment to be overcome. The closing point is, for example, set earlier instead of later at high lubricant temperatures. This results from the fact that the torque to be overcome is correspondingly lower in this case and the run up of the internal combustion engine can occur faster or, respectively, the decompression moment to be overcome is likewise smaller.

According to one advantageous modification to the invention, provision is made for a rotational speed of the internal combustion engine to be additionally or alternatively acquired as the current state value. While the previously mentioned state values represent a so-called offline correction of the decompression strategy prior to initiating a starting process, acquiring and taking into account the rotational speed of the internal combustion engine represents a so-called online correction in this case of the decompression strategy which is carried out during the starting process. By acquiring the rotational speed of the internal combustion engine, it can be determined how the starting process of said engine is taking place. If the starting process begins worse than expected, because, for example, higher decompression forces have to be overcome, said starting process can be "saved" by changing the closing time of the corresponding inlet valve, which results in succeeding cylinders being decompressed more strongly than during normal operation due to a later closing of the intake valves. If it is detected that the starting process is running better than expected, said starting process can be accelerated beyond what was originally planned at the beginning of rotation of the crankshaft by the charge in the succeeding cylinders being quickly built up. To this end, the succeeding cylinders are preferably decompressed less strongly than planned. The inlet valves are thus closed earlier than normal.

Provision is furthermore preferably made for the closing time to be selected as a function of the acquired state values such that a decompression optimal for starting the internal combustion engine takes place in the respective cylinder. This then altogether facilitates a decompression strategy which is based on outside influences as well as on state values of the internal combustion engine and optimally adjusts the closing time of the inlet valves, in particular of the succeeding cylinders, in order to ensure an optimal starting process of the internal combustion engine.

The device according to the invention is characterized by a specially equipped control device which comprises means for carrying out the method according to the invention. The means relate particularly to a processor in which the method can be executed as a program. During operation, the previously mentioned advantages for the starting process of the internal combustion engine result from said method.

The computer program product according to the invention is characterized by the fact that it carries out the inventive method when run on a computer.

BRIEF DESCRIPTION OF THE DRAWINGS

The invention is explained in greater detail below with the aid of the drawings.

In the drawings.

DETAILED DESCRIPTION

Figure 1:
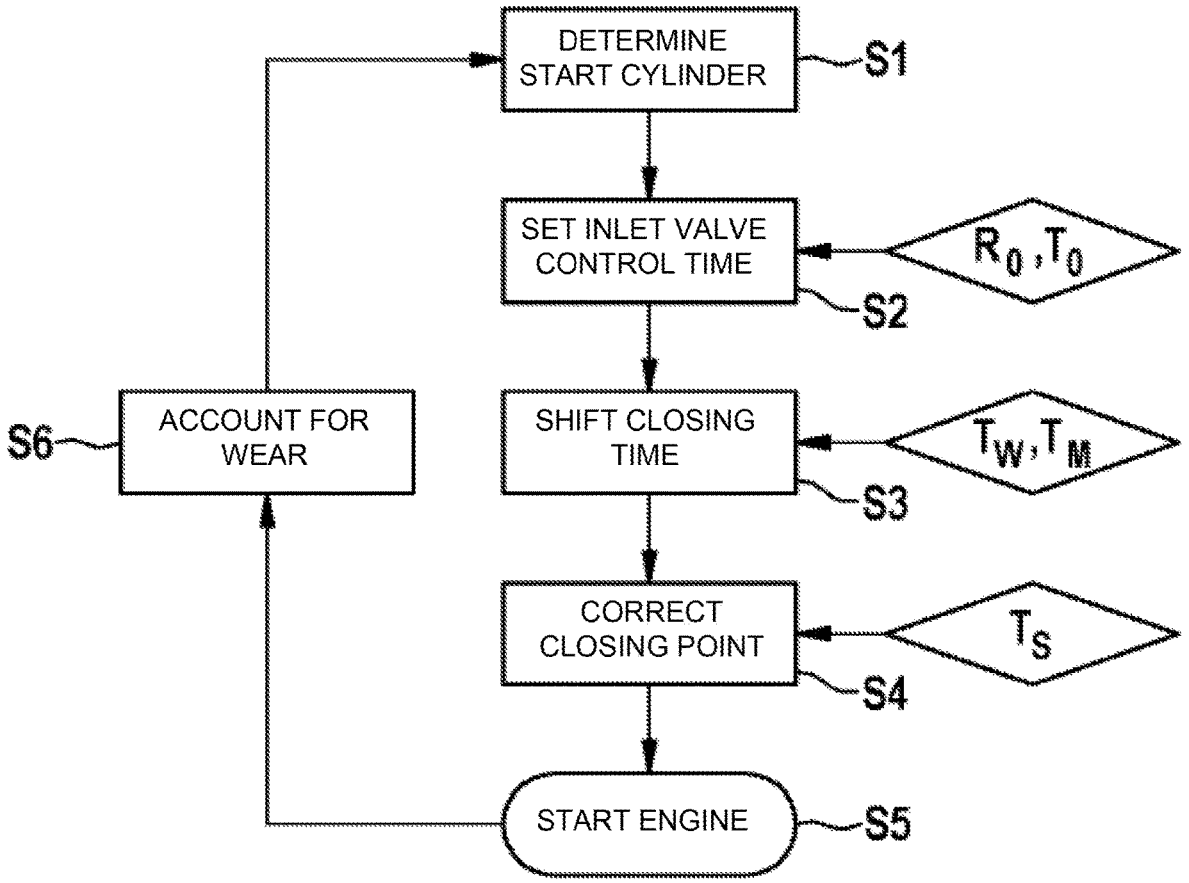
FIG. 1 shows an advantageous method for starting an internal combustion engine in a flow diagram.

In a simplified flow diagram, FIG. 1 shows a method for starting an internal combustion engine which has at least two cylinders, in the present example six cylinders, and a valve drive, wherein the valve drive has at least one inlet valve and at least one outlet valve for each of the cylinders and wherein at least the closing time of the inlet valves can be variably adjusted. The internal combustion engine further comprises a gasoline direct injection system, by means of which fuel can be directly introduced into the cylinders. An ignition device, in particular a spark plug, is furthermore associated with each of the cylinders in order to ignite the fuel introduced into the respective cylinder.

The internal combustion engine is to be put into operation by means of a direct start or, respectively, a decompression start, wherein fuel is injected into a cylinder, the piston of which is located statically in the expansion phase, and ignition is initiated. The ensuing combustion introduces a rotational movement into the crankshaft of the internal combustion engine by means of the piston. The cylinder first ignited shall be denoted below as the start cylinder.

In order to ensure an optimal start of the internal combustion engine, the advantageous method provides that, when starting said engine, the closing time of at least one inlet valve differs from at least one of the succeeding cylinders, i.e. from one of the cylinders which is after the start cylinder, in the firing order dependent on at least one current state value. In particular, the closing times of the inlet valves of the first and second cylinder succeeding in the firing order are changed dependent on at least one current state value. In so doing, a base control time for the corresponding inlet valve is initially assumed, which would ensure an optimal starting process under optimal operating conditions. This base control time is changed respectively corrected by taking into account the current state value so that the corresponding inlet valve closes earlier or later, whereby the decompression occurring in the respective cylinder is adapted. The base control time is preferably deposited in an engine control device as a function of the switch-off position of the internal combustion engine and is available as a starting position for further steps of the method. Provision is made in the present embodiment for a so-called offline correction or, respectively, adaptation of the closing time of the inlet valves to initially be carried out, as it is exemplarily depicted in FIG. 1 in a flow diagram. Because optimal staring conditions are generally not present, provision is made in the offline correction for the closing times to be changed respectively corrected dependent on ambient conditions and state conditions of the internal combustion engine, which can be acquired when said internal combustion engine is shut down. In a first step S1, the start cylinder, in which the starting process is to be initiated, is initially determined as a function of the switch-off position of the internal combustion engine. As a result, it can be determined in which succeeding cylinders the closing times of the inlet valves are to be changed. In the internal combustion engine comprising six cylinders, it is, for example, no longer necessary from the fourth cylinder onwards or, respectively, from the third succeeding cylinder to carry out a decompression; thus enabling the method to revert back to the normal closing times here. A change in the closing times for the first and the second succeeding cylinder takes place however according to the advantageous method. This will be described below in greater detail.

An ambient pressure p0 and/or an ambient temperature $T_0$ is initially acquired. In step S2, the closing time is changed or the base control time of the corresponding inlet valve is corrected as a function of the ambient pressure p0 and/or ambient temperature $T_0$. The ambient pressure and the ambient temperature determine the charge for the initial combustion as well as the compression work to be achieved by the succeeding cylinders. Provision is, for example, made for the closing time of the corresponding inlet valve to be moved backwards respectively delayed in the event of a high ambient pressure in order to cope with the increased compression work.

An engine temperature is furthermore determined, a coolant temperature $T_W$ being acquired for this purpose by means of a corresponding sensor. In step S3, the respective closing time is correspondingly further changed, i.e. shifted to an earlier or later point in time, as a function of the engine temperature $T_M$ that was acquired as stated above. The temperature $T_M$ has an effect on the friction in the internal combustion engine and therefore also on the rotational speed curve during start-up. If the closing time is correspondingly changed as a function thereof, the decompression of the succeeding cylinders can be further optimized in order to ensure a good start-up of the internal combustion engine.

Provision is furthermore made for a lubricant condition $T_S$ from a lubricant of the internal combustion engine, in particular motor oil, to be acquired. A viscosity of the lubricant is particularly acquired as the lubricant condition $T_S$, said viscosity changing with the mileage on the internal combustion engine due to abrasion, carbonization and/or fuel ingress. In step S4, the closing point of the respective inlet valve is likewise corrected as a function of the lubricant condition $T_S$ because the condition of the lubricant likewise has an effect on the friction of the internal combustion engine. This can be taken into account when optimizing the decompression of the corresponding cylinder by means of the advantageous method in order to ensure an optimal start-up.

Following the corrections carried out in steps S2, S3 and S4, the starting time up to achieving a certain minimum rotational speed of the internal combustion engine and/or the minimum rotational speed during the compression strokes of said internal combustion engine are, for example, measured. With these values, signs of wear in the internal combustion engine, which likewise effect the decompression start, can then be taken into account by means of an adaptation function in step S6, such as, for example, an engine friction which changes over the service life of the engine and/or the so-called blow-by behavior. The steps S2, S3 and S4 can, of course, also be carried out in an order that is different from the one presented here.

Whereas the closing times of the inlet valves are determined prior to start-up of the internal combustion engine during the offline correction, an adaptation and change of the closing times of the inlet valves are provided during the starting process that has already been initiated in the online correction which is described below and can additionally or alternatively take place to the offline correction. In so doing, the rotational speed n of the internal combustion engine is monitored during the starting process. To this end, the FIGS. 2 and 3 each show a diagram in which the rotational speed n of the internal combustion engine is plotted over the time t. A rotational speed curve of an optimal respectively planned start-up curve of said internal combustion engine is thereby depicted by a first curve $n_0$.

Figure 2:
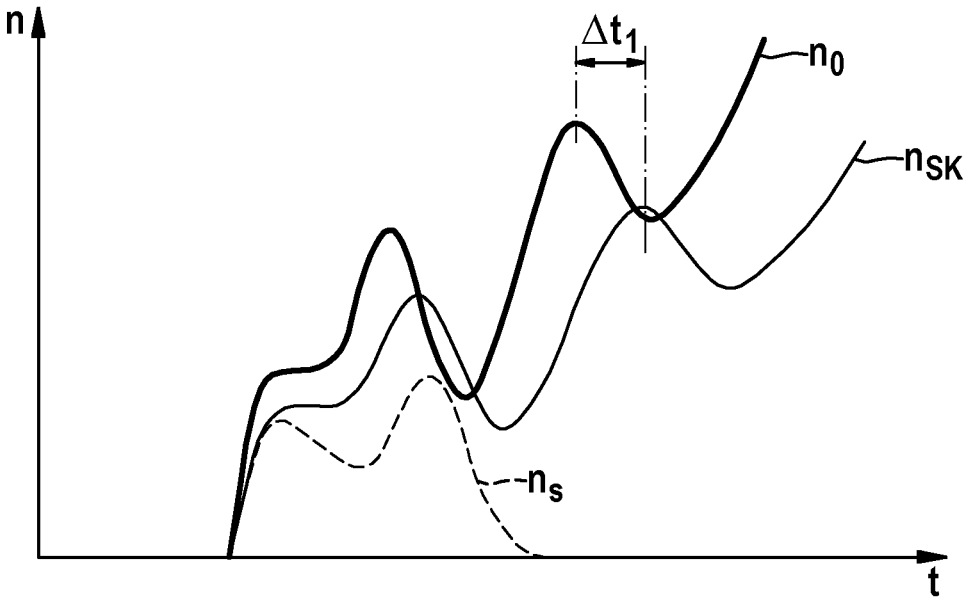
FIG. 2 shows a first exemplary embodiment of a starting process.

In the first exemplary embodiment according to FIG. 2, the actually acquired start-up curve $n_S$ has lower rotational speeds, which are caused by an insufficient decompression of the succeeding cylinders and lead to an aborted start-up.

It is however clear already at the beginning of the starting process that the acquired rotational speed $n_S$ deviates from the expected rotational speed $n_0$ and has lower values. If this is detected during a starting process, the closing times of the inlet valves of the succeeding cylinders are changed to a later point in time or, respectively, a greater decompression of the succeeding cylinders is adjusted according to the advantageous method. As a result, the start-up time of the internal combustion engine is in fact lengthened overall by the value $\Delta t_1$, as is plotted in FIG. 2. Nevertheless, the starting process can be "saved" respectively ensured as is depicted by the resulting rotational speed $n_{SK}$.

As a result of the greater decompression, the start-up is still saved because the rotational speed n during the compression of the respective succeeding cylinder does not drop as dramatically as with unchanged closing times.

Figure 3:
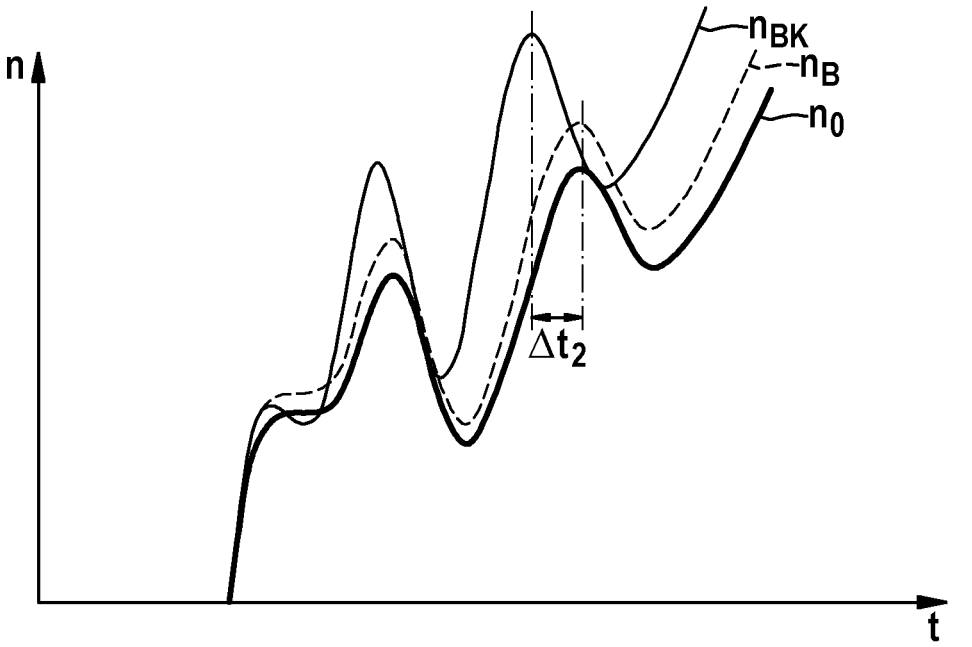
FIG. 3 shows a second exemplary embodiment of the starting process.

FIG. 3 shows a rotational speed curve $n_B$ which is improved in comparison to the expected rotational speed curve $n_0$ and which leads to higher rotational speeds than expected already at the beginning of the starting process. In this case, the start-up curve can be accelerated still further by the respective cylinder charge being built up faster than was originally planned at the beginning of rotation. To this end, the closing times of the inlet valves of the succeeding cylinders are shifted to an earlier point in time so that the succeeding cylinders are less strongly decompressed in a planned manner as originally by means of the base control time. As a result, the internal combustion engine is accelerated faster and the resulting rotational speed $n_{BK}$ reaches the minimum rotational speed faster. The start-up time is thereby shortened by the value $\Delta t2$ plotted in FIG. 3.

The invention claimed is:

1. A method for starting an internal combustion engine for a motor vehicle, said internal combustion engine having at least two cylinders, a valve drive with at least one inlet valve and at least one outlet valve for each of the cylinders, wherein at least closing times of the inlet valves can be variably adjusted, and a direct injection system, the starting process being initiated by a direct injection and ignition in one of the cylinders, characterized in that, during the starting process, the closing time of the at least one inlet valve of one cylinder differs from the at least one valve of the other cylinders dependent on at least one current state value; wherein a rotational speed (n) of the internal combustion engine is detected during the start-up process as one of the at least one current state values and a lubricant condition ($T_S$) of the internal combustion engine is acquired as another of the at least one current state values, and during the startup process, changing the closing times of the intake valves of the other cylinders to a later time when the detected rotational speed (n) is less than an expected speed and changing the closing times of the intake valves of the other cylinders to an earlier time when the detected rotational speed (n) is greater than the expected speed; wherein the lubricant condition (TS) of the internal combustion engine is a viscosity of the lubricant of the internal combustion engine acquired via a sensor.

2. The method according to claim 1, characterized in that an ambient temperature ($T_0$) is acquired as one of the at least one current state value.

3. The method according to claim 1, characterized in that an ambient pressure ($p_0$) is acquired as one of the at least one current state value.

4. The method according to claim 1, characterized in that an engine temperature ($T_M$) is ascertained as one of the at least one current state value.

5. The method according to claim 1, characterized in that the closing time of the at least one inlet valve is selected as a function of the at least one state value acquired, such that a decompression for the starting process occurs in the corresponding cylinder.

6. A device for operating an internal combustion engine having at least two cylinders, a valve drive with at least one inlet valve and at least one outlet valve for each of the cylinders, wherein at least closing times of the inlet valves can be variably adjusted, and a direct injection system, the device comprising a control device configured to, during a starting process, adjust a closing time of at least one inlet valve different from at least one valve of the other cylinders dependent on at least one current state value; wherein a rotational speed (n) of the internal combustion engine is detected during the start-up process as one of the at least one current state values and a lubricant condition ($T_S$) of the internal combustion engine is acquired as another of the at least one current state values, and during the startup process, changing the closing times of the intake valves of the other cylinders to a later time when the detected rotational speed (n) is less than an expected speed and changing the closing times of the intake valves of the other cylinders to an earlier time when the detected rotational speed (n) is greater than the expected speed; wherein the lubricant condition (TS) of the internal combustion engine is a viscosity of the lubricant of the internal combustion engine acquired via a sensor.

7. A non-transient computer readable medium containing a computer program product which carries out the method according to claim 1 when the program is executed on a control device.

* * * * *